US009075385B2

(12) United States Patent
Fukuhata et al.

(10) Patent No.: US 9,075,385 B2
(45) Date of Patent: Jul. 7, 2015

(54) FIXING DEVICE WITH HOLLOW CORE HEAT ROLLER AND IMAGE FORMING APPARATUS WITH SAME

(71) Applicants: Yoshihiro Fukuhata, Hyogo (JP); Yoshiharu Takahashi, Osaka (JP)

(72) Inventors: Yoshihiro Fukuhata, Hyogo (JP); Yoshiharu Takahashi, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 8 days.

(21) Appl. No.: 14/022,295

(22) Filed: Sep. 10, 2013

(65) Prior Publication Data

US 2014/0072357 A1 Mar. 13, 2014

(30) Foreign Application Priority Data

Sep. 13, 2012 (JP) ..... 2012-201557

(51) Int. Cl.
*G03G 15/20* (2006.01)
*G03G 21/16* (2006.01)

(52) U.S. Cl.
CPC ..... *G03G 21/1685* (2013.01); *G03G 15/2053* (2013.01); *G03G 2215/2038* (2013.01)

(58) Field of Classification Search
CPC ..... G03G 21/1685
USPC ..... 399/328, 329
See application file for complete search history.

(56) References Cited

U.S. PATENT DOCUMENTS 5,974,294 A * 10/1999 Tange ..... 399/328
2001/0022909 A1* 9/2001 Takeuchi et al. ..... 399/328
2007/0223976 A1 9/2007 Yagi et al.
2007/0292175 A1* 12/2007 Shinshi ..... 399/329
2008/0013992 A1 1/2008 Fukuhata et al.
2008/0013993 A1 1/2008 Obata et al.
2008/0031664 A1 2/2008 Yagi et al.
2008/0063442 A1 3/2008 Yagi et al.
2008/0069611 A1 3/2008 Obata et al.
2008/0219727 A1* 9/2008 Seol ..... 399/330
2010/0178089 A1 7/2010 Fukuhata
2010/0239297 A1 9/2010 Sakaya et al.
2010/0260524 A1 10/2010 Hiraoka et al.
2010/0272481 A1 10/2010 Yamamoto et al.
2011/0052285 A1 3/2011 Fukuhata
2011/0058866 A1 3/2011 Ishii et al.

(Continued)

FOREIGN PATENT DOCUMENTS

JP 60015664 A * 1/1985
JP 08137313 A * 5/1996

(Continued)

*Primary Examiner* — Quana M Grainger
(74) *Attorney, Agent, or Firm* — Harness, Dickey & Pierce, P.L.C.

(57) ABSTRACT

An image forming apparatus includes an image forming unit to form a toner image on a recording medium and a fixing device. The fixing device includes a fixing belt to fix a toner image onto a recording medium transported to a fixing nip, a pressing member pressed against the fixing belt to form the fixing nip therebetween, a heating roller accommodating a heater to heat the fixing belt. A holder is provided to hold the heater at one end of the heater. An inner diameter of the heating roller and an outer diameter of the holder are substantially the same, and the heating roller and the holder partially overlap with each other in an axial direction of the heating roller. The interior and the exterior of the heating roller are preferably insulated by the heating roller and the holder by a prescribed degree not to change air pressure in the heating roller.

18 Claims, 5 Drawing Sheets

(56) References Cited

U.S. PATENT DOCUMENTS

| | | | | |
|---|---|---|---|---|
| 2011/0188874 | A1 | 8/2011 | Takahashi et al. | |
| 2011/0311283 | A1 | 12/2011 | Fukuhata | |
| 2012/0020681 | A1 | 1/2012 | Naitoh et al. | |
| 2012/0020690 | A1 | 1/2012 | Yamamoto et al. | |
| 2012/0045241 | A1 | 2/2012 | Takahashi et al. | |
| 2012/0195652 | A1 | 8/2012 | Takahashi et al. | |
| 2012/0251208 | A1* | 10/2012 | Hasegawa | 399/329 |
| 2013/0004213 | A1 | 1/2013 | Takahashi | |
| 2013/0004214 | A1 | 1/2013 | Sakaya et al. | |
| 2013/0004217 | A1 | 1/2013 | Ikeda et al. | |
| 2013/0004222 | A1 | 1/2013 | Sakaya et al. | |
| 2013/0164667 | A1* | 6/2013 | Kamiwaki et al. | 430/107.1 |

FOREIGN PATENT DOCUMENTS

| | | | |
|---|---|---|---|
| JP | 2000221825 A | * | 8/2000 |
| JP | 2011-059247 | | 3/2011 |

* cited by examiner

FIXING DEVICE WITH HOLLOW CORE HEAT ROLLER AND IMAGE FORMING APPARATUS WITH SAME

CROSS-REFERENCE TO RELATED APPLICATION

This patent application is based on and claims priority pursuant to 35 U.S.C. §119 to Japanese Patent Application No. 2012-201557, filed on Sep. 13, 2012 in the Japan Patent Office, the entire disclosure of which is hereby incorporated by reference herein.

BACKGROUND

1. Technical Field

The invention relates to a fixing device and an image forming apparatus with the same.

2. Related Art

A fixing device that fixes an unfixed toner image formed on a recording medium, such as a transfer sheet, an OHP (overhead projector) sheet, etc., (hereinafter, simply referred to as a sheet) by heat and pressure in an image forming apparatus, such as a copier, a printer, a facsimile machine, etc., is well known. In such a fixing device, a belt fixing system with an endless fixing belt capable of shortening a warm-up time while consuming less power is known.

For example, a belt-fixing device capable of adjusting a condition of a fixing nip to preferably execute fixing is disclosed in JP-2011-59247-A.

However, in a conventional belt-fixing device, in which a heater is installed in a heating roller, because the diameter of the heating roller is relatively large a gap between the heater and the heating roller is also large. Accordingly, an excessive amount of energy is needed to heat the large volume of air inside the heating roller. The above-described fixing device disclosed in JP-2011-59247-A may not resolve this problem of poor energy efficiency.

SUMMARY

Accordingly, one aspect of the present invention provides a novel fixing device that includes a fixing belt to fix a toner image onto a recording medium transported to a fixing nip, a pressing member pressed against the fixing belt to form the fixing nip therebetween, and a heating roller accommodating a heater to heat the fixing belt. A holder is provided to hold the heater at one end of the heater. An inner diameter of the heating roller and an outer diameter of the holder are substantially the same, and the heating roller and the holder partially overlap with each other in an axial direction of the heating roller.

Another aspect of the present invention provides a novel image forming apparatus that includes an image forming unit to form a toner image on a recording medium and a fixing device. The fixing device includes a fixing belt to fix a toner image onto a recording medium transported to a fixing nip, a pressing member pressed against the fixing belt to form the fixing nip therebetween, and a heating roller accommodating a heater to heat the fixing belt. A holder is provided to hold the heater at one end of the heater. An inner diameter of the heating roller and an outer diameter of the holder are substantially the same, and the heating roller and the holder partially overlap with each other in an axial direction of the heating roller.

Yet another aspect of the present invention provides a novel image forming apparatus that includes an image forming unit to form a toner image on a recording medium and a fixing device. The fixing device includes a fixing belt to fix a toner image onto a recording medium transported to a fixing nip, a hollow heating roller accommodating therewithin a heater to heat the fixing belt, and a holder to hold the heater at one end of the heater. An inner diameter of the heating roller and an outer diameter of the holder are substantially the same, and the heating roller and the holder partially overlap with each other in an axial direction of the heating roller.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
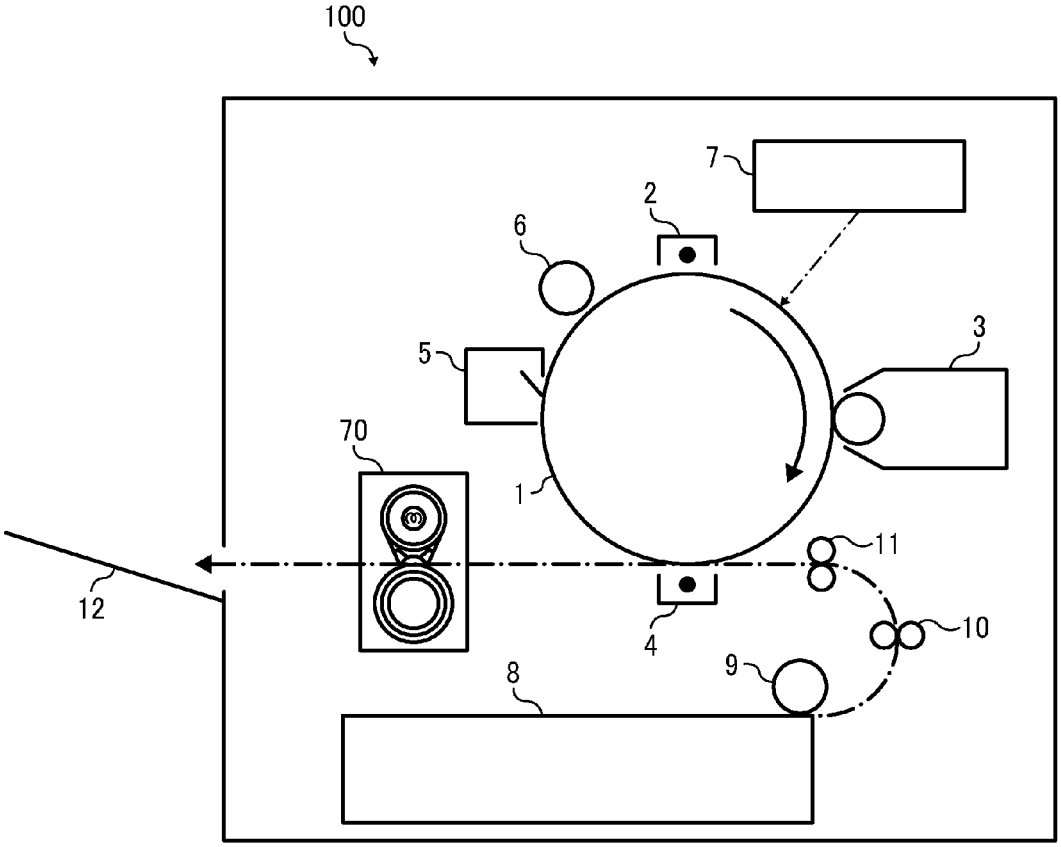
FIG. 1 is a diagram schematically illustrating an outline configuration of an exemplary laser printer including a fixing device according to one embodiment of the present invention.

Referring now to the drawings, wherein like reference numerals designate identical or corresponding parts throughout the several views thereof and in particular to FIG. 1, an outline configuration of an exemplary laser printer 100 including a fixing device according to one embodiment of the present invention is initially described. As shown in the drawing, the laser printer 100 includes a photosensitive drum 1 as an image bearer. Around the photoconductive drum 1, a charging unit 2, a developing unit 3, a transfer unit 4, a cleaning unit 5, and a charge-removing unit 6 are disposed. An exposure position is provided between the charging unit 2 and the developing unit 3, and writing light is emitted onto the photoconductive drum 1 from the laser writing unit 7 placed at an upper part in the laser printer 100.

The printer includes a sheet cassette 8 at a lower part thereof, a sheet-feeding roller 9, a pair of conveying rollers 10, and a pair of registration rollers 11 or the like collectively to feed the sheet in the printer. A fixing device 70 described later in detail is also disposed downstream of a transfer section in which the photoconductive drum 1 and the transfer unit 4 are opposed to each other.

Now, exemplary image forming operation executed in the laser printer 100 configured as above is briefly described. When image forming operation is initiated, the photoconductive drum 1 is driven and rotated clockwise by a driving device, not illustrated in the drawing, and a surface of the photosensitive drum 1 is uniformly charged with electric charge in a prescribed polarity by a charging unit 2. A LD (laser diode), not shown, is driven based on image data sent from a host machine such as PC, etc., in the laser writing system 7, and laser light as a writing beam is emitted onto the photosensitive drum 1. With this, an electrostatic latent image is formed on the photoconductive drum 1. The electrostatic latent image is then provided with toner by a developing unit 3 and is rendered visible as a toner image.

Meanwhile, from the sheet-feeding cassette 8, a recording sheet is launched by the sheet-feeding roller 9, and is transported by the pair of conveying rollers 10. The sheet temporarily stops at a registration roller 11 by colliding therewith, and is dispatched therefrom synchronizing with the above-described visible image thereafter. The above-described toner image is then transferred onto the sheet in the transfer section, in which the photoconductive drum 1 and the transfer unit 4 are opposed to each other. The toner image is fixed onto the sheet while being heated and pressed when the sheet bearing the transferred toner image passes through the fixing device 20. The sheet is ejected by a pair of exit rollers, not illustrated in the drawing, and is stacked on a sheet exit tray 12 after the toner image is fixed thereonto.

After transferring the toner image onto the sheet, foreign material, such as residual toner, adhering to the surface of the photosensitive drum 1 is removed by a cleaning unit 5, and residual charge remaining on the surface of the photosensitive drum 1 is also removed by a charge removing thermocouple device 6 to prepare for the next image formation.

Figure 2:
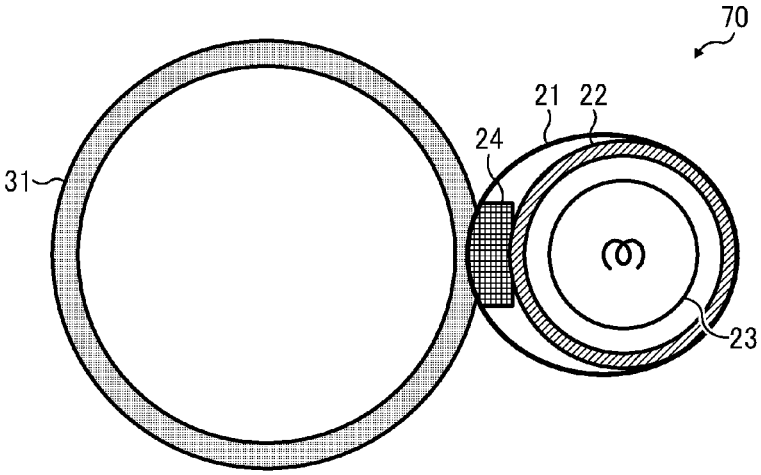
FIG. 2 is a cross-sectional view illustrating a configuration of a main part of the fixing device according to one embodiment of the present invention.

FIG. 2 is a cross-sectional view illustrating an exemplary configuration of a main part of the fixing device 70 according to one embodiment of the present invention. As shown in the drawing, the fixing device 70 is configured by a fixing belt 21 as a fixing member formed from an endless-belt member, a heating roller 22 provided inside the loop formed by the fixing belt 21 to deliver heat to the fixing belt 21 and hold the belt member, and a halogen heater 23 serving as a heater (i.e., a heat source). The fixing device 70 further includes a thermistor (not shown) serving as a temperature sensor to detect surface temperature of the fixing belt 21 by either contacting or approaching the fixing belt 21, a fixing pad 24 provided inside the loop formed by the fixing belt and in contact with the heat roller 22 to hold the fixing belt 21, and a pressing roller 31 serving as a pressing member to form a fixing nip by contacting the fixing belt 21 from outside the loop formed by the fixing belt 21.

The above-described fixing pad 24 is made of elastic material, such as silicone rubber, fluoro-rubber, etc., or heat-resistant plastic or metal, and directly or indirectly contacts an inner surface of the fixing belt 21 through a sliding sheet member. Specifically, the fixing pad 24 can indirectly slide on the inner surface of the fixing belt 21 through lubricant such as grease, etc., beside the sliding sheet. The fixing pad 24 also serves as a nip-forming member by contacting the pressing roller 31 under pressure across the fixing belt 21 to form the fixing nip therebetween.

Hence, through the sliding sheet and the fixing belt 21, the fixing pad 24 is pressed against the pressing roller 31, and forms the fixing nip based on pressure of the fixing pad 24 and load applied from the pressing roller 31, so that the toner image can be fixed by pressure and heat generated in the fixing nip.

The pressing roller 31 is prepared from a hollow or solid metal roller, an elastic layer with thermally stable characteristics, such as silicone rubber etc., and a releasing layer (e.g. a PFA resin layer or a PTFE resin layer) on its outer circumferential surface to obtain releasability thereof. Further, driving force is transmitted from a power source such as a motor, etc., installed in the image forming apparatus 1 to the pressing roller 31 via a gear train. Thus, the pressing roller 31 is driven and rotated in a prescribed direction.

The pressing roller 31 is pressed against the fixing belt by a pressing mechanism, not illustrated in the drawing. Thus, the rubber layer of the pressing roller 31 is crushed and deformed, so that the fixing nip is formed with a prescribed width. Further, the pressing roller 31 can be provided with a heat source, such as a halogen heater, etc. The silicone rubber layer formed on the pressing roller 31 may be solid rubber. Otherwise, when the pressing roller 31 is not provided with the heat source in its interior, sponge rubber may be utilized. The sponge rubber is more desirable, because thermal insulation is enhanced and heat of the fixing belt is rarely conducted to the pressing roller.

The fixing belt 21 is made of metal, such as nickel, stainless steel, etc., or resin, such as polyimide, polyamide, fluorine resin etc., and is formed in a state of an endless belt (or film). In this example, the polyimide belt is employed as one example.

Further, a mold-releasing layer made of resin, such as PTFE (polytetrafluoroethylene), PFA (tetrafluoroethylene-perfluoroalkylvinyl ether), etc., is provided as an outer surface layer of the fixing belt 21 to give releasability to inhibit the toner on the recording medium to adhere thereto. Further, between a substrate of the fixing belt 21 and the PFA resin layer (or the PTFE resin layer), an elastic layer made of silicone rubber or the like may be formed.

If the silicone rubber layer is absent, heat capacity is reduced improving fixing performance. However, an unfixed toner image is crushed and subtle irregularities generated on the surface of the fixing belt are transferred onto an image, so that a mark like an orange peel skin is left on a solid image as a problem. To overcome this problem, a silicone layer having a thickness of more than 100 micrometers may be provided. Specifically, the subtle irregularities are absorbed by deformation of the silicone layer and the image like an orange peel skin can be reduced.

As a core member of the hollow heating roller 22 is a pipe state and is made of metal, such as aluminum, iron, stainless steel, etc. The heating roller 22 of this embodiment is cylindrical and includes a diameter larger than an apparent diameter of the halogen heater that serves as the heater by about 1 mm. In order to help absorb radiant heat emitted from the halogen heater or the like, an inner surface of the heating roller 22 is coated with black color material.

The above-described heating roller 22 is provided in contact with the fixing pad 24. Here, pressure of the pressing roller 31 pressing the fixing belt 21 is conveyed to the fixing belt 21, the sliding sheet (not shown), and the fixing pad 24, and is ultimately received by the heating roller 22 or the fixing pad 24. In this embodiment, the heating roller 22 is driven and rotated by a driving mechanism, not shown in the drawing. A direction and a speed of the rotation of the heating roller 22 are roughly equivalent to those of the fixing belt 21. Further, the halogen lamp is chosen as the heat source to raise temperature of the heating roller 22 in this embodiment. However, if a gap between it and the heating roller is reduced or a gap (between a heater knob connected to a heater and the heating roller) is almost eliminated at an end of the heating roller, a carbon heater or a resistance-heating element can be employed as well.

The pressing roller 31 drives the fixing belt 21. That is, the fixing belt 21 is rotated because the pressing roller 31 is driven and rotated by a driving source, not shown in the drawing, and that driving force is transmitted to the fixing belt 21 via the fixing nip. The fixing belt 21 is sandwiched by the pressing roller 31 and the fixing pad 24 in the fixing nip to rotate. Further, the fixing belt 21 is guided and transported by the fixing pad 24 outside the fixing nip.

To reduce the sliding load between the inner surface of the fixing belt 21 and a pressing member (i.e., the fixing pad 24), lubricant, such as fluorinated greases, silicon oil, etc., is applied to the inner surface of the fixing belt 21. As a result, the lubricant can intervene in between the heating roller 22 and the fixing belt 21. Further, since the heating roller 22 is designed to convey the fixing belt 21, the surface of the inner surface of the fixing belt 21 is slightly roughened so as to convey driving force and keep the lubricant there. As a manner of roughening the surface of the heating roller 22, a method of physically roughening the surface such as sandblasting, etc., chemically roughening the surface such as etching, etc., or roughening the surface by coating it with prescribed paint prepared by mixing beads having a small diameter may be used.

Here, toner used in this embodiment may be crushed toner or polymerized toner obtained by adding 2-parts of hydrophobic silica RY-50 (manufactured by AEROSIL Co, Ltd.) to 100-parts of toner, while mixing them with 20L-Henschel mixer at circumferential speed of about 40 m/sec for 5-minutes. Then, a sieve having an opening of about 75 micrometer sieves the mixing resultant member.

Figure 3:
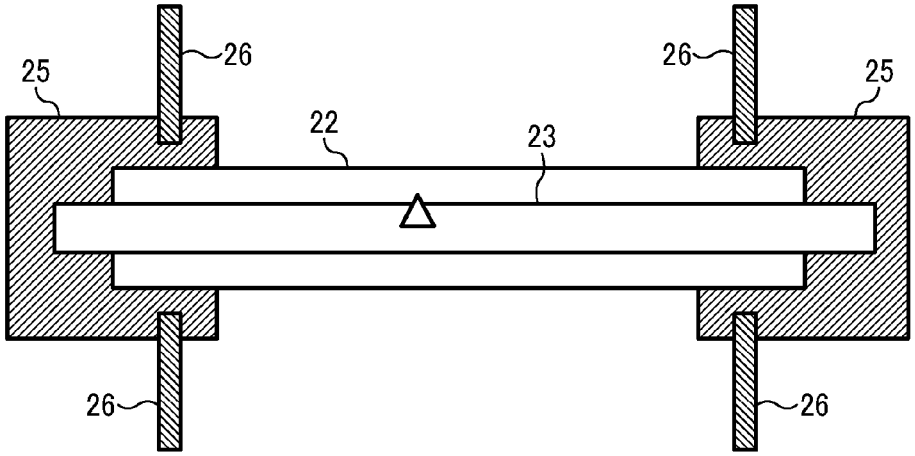
FIG. 3 is a cross-sectional view illustrating a heating roller taken along its rotational center according to one embodiment of the present invention.

FIG. 3 is a central cross-sectional view illustrating a heating roller 22 taken along its rotation centerline according to one embodiment of the present invention. As shown in FIG. 3, reference numerals 26 and 26 denote left and right side plates attached and positioned at a main frame (not shown) of the fixing device. A pair of bearings 25 supporting the heating roller 22 is attached to the above-described side plates 26 by sliding them on the above-described side plates 26, respectively. Specifically, the pair of bearings 25 is attached thereto by partially inserting side plates 26*a* into a pair of recesses 25*a* formed in the bearings (see, FIG. 4) respectively. Thus, by sliding and mounting the bearings 25 onto the side plates 26, a ring or a screw as a retainer for retaining the bearings 25 can be omitted. Hence, the costs of parts and assembly can be reduced, and the longitudinal position of the heating roller 22 can be fixed with a simple configuration at low cost again.

Figure 4:
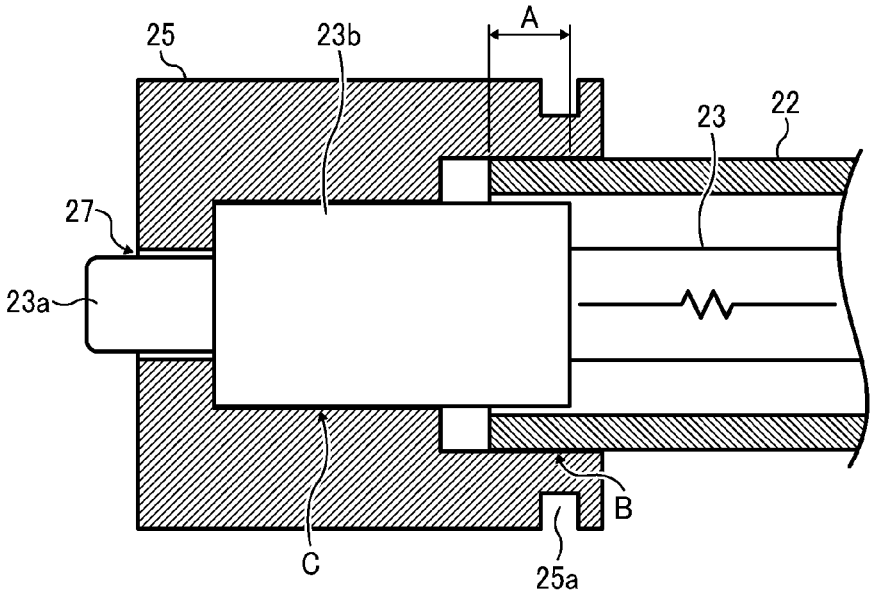
FIG. 4 is a cross-sectional view illustrating one end of the heating roller according to one embodiment of the present invention.

FIG. 4 is a cross-sectional view illustrating one end of the heating roller according to one embodiment of the present invention. Although FIG. 4 only shows the one end, the other end has the same configuration as well. As shown there, a heater (e.g. a halogen heater) 23 is installed in the heating roller 22. The heater (e.g. a halogen heater) 23 and the heating roller 22 are held by the bearings 25. Specifically, the embodiment is described herein below supposing that the halogen heater is used as the heater 23. In this example, the heating roller 22 and the heater 23 are placed on the same concentric circles, respectively, to minimize an internal diameter of the heating roller 22. For the same purpose, a distance between an inner surface of metal core of the heating roller and the halogen heater 23 is also narrowly set to minimize the internal diameter again. Here, both members are prevented from contacting each other because the heating roller 22 needs to rotate safely without confliction in this embodiment. Therefore, the interval between the heating roller 22 and the halogen heater 23 needs at least about 0.1 mm or more supposing that the heating roller 22 is bent due to load or the like.

Further, as shown in the diagram, the halogen heater 23 is deployed in the heating roller 22 as a heater and a heater body (i.e., a lighting and heat-generating section) of the halogen heater 23 is held by a heater holding member (hereafter referred to as a heater knob 23*b*) at one end thereof. As one feature of this embodiment of the present invention, an outer diameter of the heater knob 23*b* and the inner diameter of the heating roller 22 are almost the same, so that an inner circumferential surface of the heating roller 22 and the outer circumferential surface of the heater knob 23*b* approximate each other. Further, the heating roller 22 and the heater knob 23*b* extend in an axial direction of the heating roller 22 partially overlapping with each other at an overlapping region as shown in the drawing.

When the gap (i.e., the gap between the inner circumferential surface of the heating roller 22 and the outer circumferential surface of the heater knob 23*b*) widens at the end of the heating roller 22, heat generated in the heating roller comes to escape from the heating roller 22 as a result. Thus, the gap needs to be minimized as narrower as possible to reduce heat loss. Accordingly, as described below in more detail, the above-described gap is preferably to be set to from about 0.1 mm to about 2 mm for that purpose.

However, a gap between a heater and a roller provided outer side thereof is neglected when designing a conventional fixing device. For example, one conventional belt-fixing device is composed of a heating roller having an inner diameter of about 19 mm and a glass tube having an (outer) diameter of about 9 mm with a gap of about 5 mm.

Figure 5:
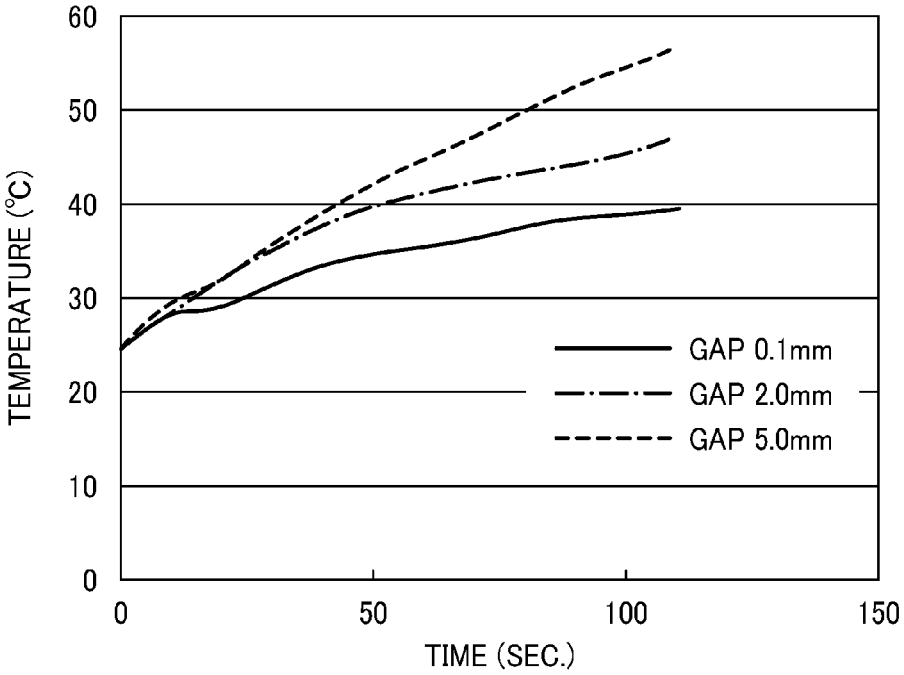
FIG. 5 is a graph illustrating ambient temperature around an end of the heating roller, which changes in accordance with a gap between the heating roller and a heater knob according to one embodiment of the present invention.

In such a situation, when the gap between the heating device and the heating roller outside thereof is 2 mm or less, an amount of heat radiation decreases, so that thermal energy can be relatively efficiently used. FIG. 5 is a graph illustrating ambient temperature around a roller end obtained by changing the gap between the heating roller 22 and the heater knob 23*b* at respective ends thereof according to one embodiment of the present invention. A solid line in the graph illustrates when the gap is about 0.1 mm. A dashed line in the graph illustrates when the gap is about 2 mm. A broken line in the graph illustrates when the gap is about 5 mm. A result in the graph is derived based on below-described conditions. As to temperature of the heating roller, it is raised from room temperature (i.e., about 25° C.) up to about 150 degrees centigrade within about 10 seconds, and is then maintained at about 150 degrees centigrade. The temperature is measured by a thermocouple at one end of the heating roller. The heating roller is in a stationary state (i.e., it is not rotated). Under such conditions, when the gap is set to about 5 mm, the temperature rises from about 25 degrees to about 58 degrees centigrade, with an increase of about 33 degrees centigrade within about 120 seconds. By contrast, when the gap is narrowed down to about 0.1 mm, the temperature increase has been about 14 degrees centigrade. Therefore, it is understood that the heat is difficult to escape from the heating roller via the narrower gap. Here, since the temperature increase is recognized as about 22 degrees centigrade when the gap is set to about 2 mm, it has been found that the temperature increase can be suppressed to be about 66% of that obtained when the gap is about 5 mm. Therefore, it is understood that it is difficult for the heat to escape from the heating roller via the narrower gap. Here, since the temperature increase is recognized as about 22 degrees centigrade when the gap is set to about 2 mm, it has been found that the temperature increase can be suppressed to be about 66% of that obtained when the gap is about 5 mm. Therefore, it can be understood that the above-described gap is most effective (i.e., most advantageous) when set from about 0.1 mm to about 2 mm.

Further, the reason for setting the above-described gap to at least 0.1 mm is as follows. Specifically, it is self-explanatory that thermal energy can be effectively used by completely retaining air within the heating roller not to escape from the heating roller. However, the air is actually warmed by heat, and accordingly various problems, such as pressure increase in the heating roller, generation of water droplets therein, etc. Therefore, a prescribed gap is preferably formed not to cause such pressure and water droplets challenges and to obtain the fixing device at low-cost. Then, in this example, the gap is set to about 0.1 mm to avoid the above-described challenges while avoiding contact of both parties as well. Further, the support member (i.e., the bearing 25) that supports the halogen heater and the heating roller 22 needs a hole for drawing wiring of the halogen heater 23 from an interior of it to an exterior of the heating roller 22.

Further, in the illustrated example, a hole 27 is provided on an outer side of the end of the heating roller 22 on the same axis with the heating roller 22 to draw out the wiring (i.e., a harness 23*a*) therefrom.

Further, the support member (i.e., the bearing 25) needs a heat-resistance capable of resisting to 250° C., because it contacts the heating roller 22 and/or the heater knob 23*b*. Further, since the heating roller 22, the heater knob 23*b*, and the supporting member 25 cause thermal expansion when heated, coefficients of thermal expansion of these devices need to satisfy the following inequality;

> a coefficient of thermal expansion of the support member(i.e., the bearing 25)>that of the heating roller 22 and/or that of the heater handle section 23*B*.

In addition, a portion of the support member (i.e., the bearing 25) almost contacting the heating roller 22 has a risk to contact the fixing belt 21. Therefore, a deviation suppressing system (not shown) capable of suppressing deviation of the fixing belt 22 is provided to avoid such contact of those parties.

Figure 6:
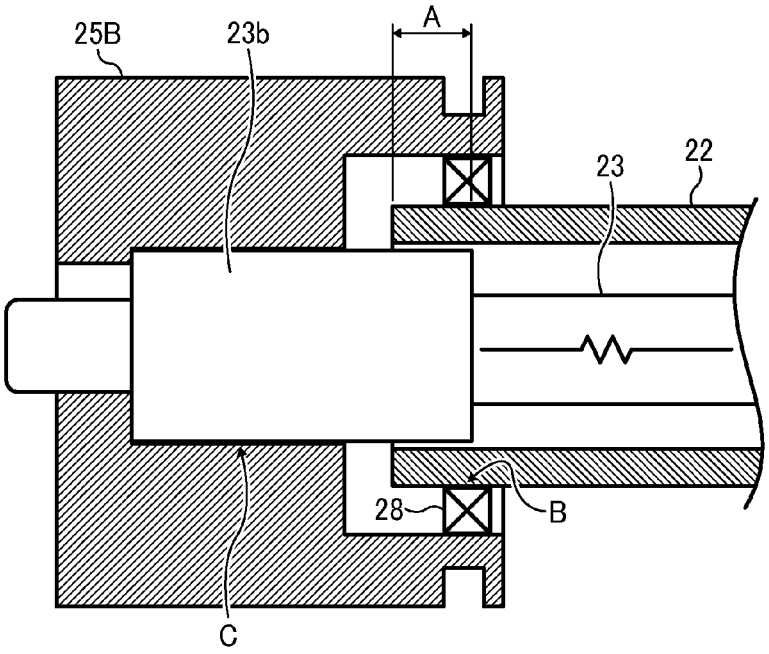
FIG. 6 is a cross-sectional view illustrating a variation that utilizes a ball bearing as a bearing supporting the heating roller according to one embodiment of the present invention.

FIG. 6 is a cross-sectional view illustrating a variation that employs a ball bearing 28 at a contact section contacting the heating roller according to one embodiment of the present invention. Although FIG. 6 only shows the one end, the other end has the same configuration as well. Hence, by supporting the heating roller 22 with the ball bearings 28, a driving torque for driving the heating roller 22 can be reduced. Here, a support system supporting the halogen heater 23 may be the same as that in FIG. 4. Further, in this example, the inner diameter of the heating roller 22 and the outer diameter of the heater knob 23*b* are again almost the same to each other, and the heating roller 22 and the heater knob 23*b* are also configured to partially overlap in the axial direction of the heating roller 22.

Figure 7:
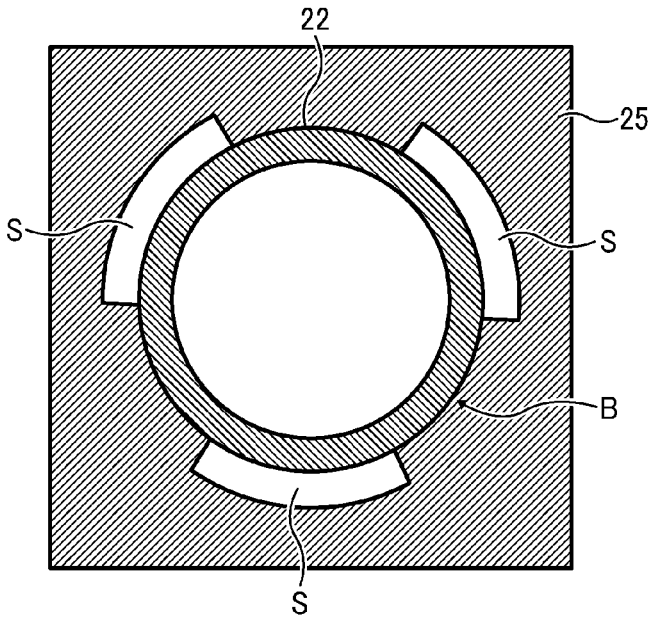
FIG. 7 is a cross-sectional view illustrating a configuration of the bearing having a non-contact section in a supporting section supporting the heating roller in the bearing member according to one embodiment of the present invention.

Here, in the configuration shown in FIG. 4, the bearing 25 contact the heating roller in its circumferential direction (over the entire circumference thereof). By contrast, more than one non-contact section (a section in which the bearing member does not contact) may be partially provided in the circumferential direction of the heating roller as shown in FIG. 7. Specifically, a load torque and accordingly energy consumption of a driving motor can be reduced by reducing the contact area in which the heating roller 22 and the bearing 25 contact each other as a result. At the same time, the driving motor can be downsized due to reduction of the torque needed for the driving motor. Furthermore, since the sliding friction generated between the heating roller 22 and the bearing 25 can be reduced, shaves of parts can be likely suppressed while reducing occurrence of noise. Furthermore, parallelism (i.e., a not tilting condition) of the heating roller 22 can be readily kept even if the parts are shaved while reducing asymmetry deviation of the fixing belt 21.

Figure 8:
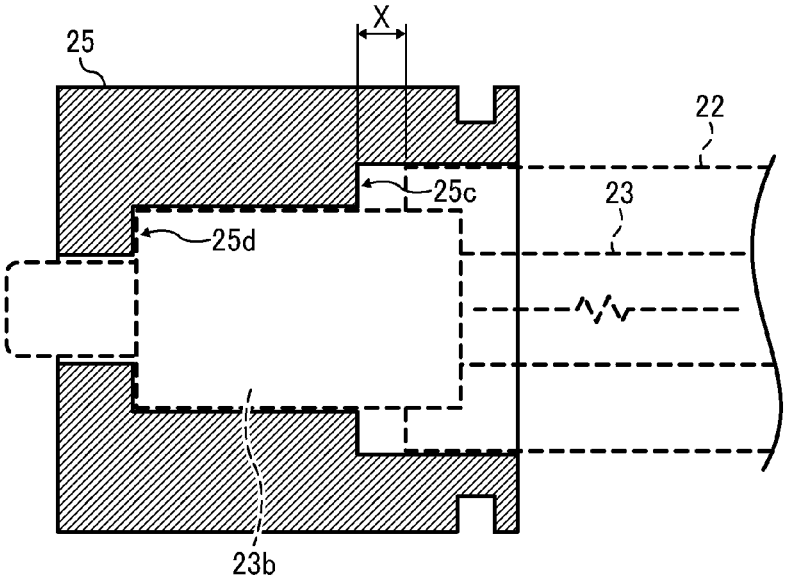
FIG. 8 is a cross-sectional view illustrating a securing section of a support member securing both the heating roller and the heater in an axial direction of the heating roller according to one embodiment of the present invention.

FIG. 8 is a cross-sectional view illustrating an exemplary configuration of a securing section of the support member which secures both the heating roller 22 and the heater 23 in an axial direction of the heating roller 22 according to one embodiment of the present invention. Although FIG. 8 only shows the one end, the other end has the same configuration as well. Here, the exemplary configuration of a securing section of the support member is described based on the bearing 25 shown in FIG. 4. However, the support member 25*b* in FIG. 6 can be also based as well.

As shown in FIG. 8, in the bearing 25, a heating roller securing section 25*c* is provided to receive and secure the heating roller 22. Also provided in the bearing 25 is a heater securing section 25*d* that receives and secures the heater (e.g., the halogen heater) 23. Since the heating roller securing section 25*c* receives the end of the heating roller 22, the heating roller 22 can avoid from falling down in a longitudinal direction without employing a stopping member such as a retaining ring, etc. Accordingly, the cost can be reduced because an additional part can be omitted. Similarly, since the end of the heater knob 23*b* is received by the heater-securing member 25*d*, the heater 23 can avoid from falling down without employing a heater regulatory member. Accordingly, the cost reduction can be again achieved because an additional member is not needed again.

Further, a given gap X having a predetermined size is provided between the heating roller 22 and a (vertical) wall of the heating roller-securing member 25*c* in the bearing 25. Hence, the bearing 25 can likely prevent from corrupting by repeatedly receiving a stress caused by expansion and contraction of the heating roller 22 when it causes thermal expansion.

Figure 9A:
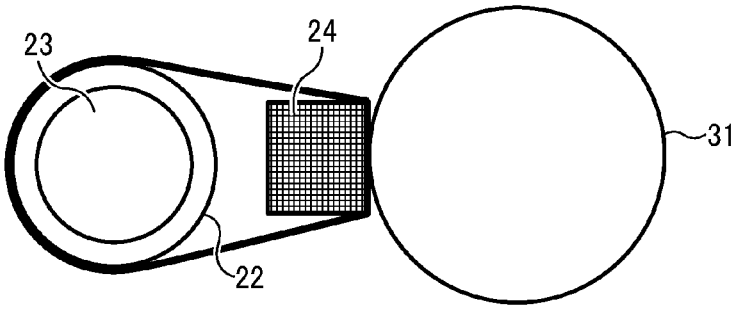
FIGS. 9A, 9B, and 9C are diagrams schematically collectively illustrating various structures of the fixing device according to one embodiment of the present invention.
Figure 9B:
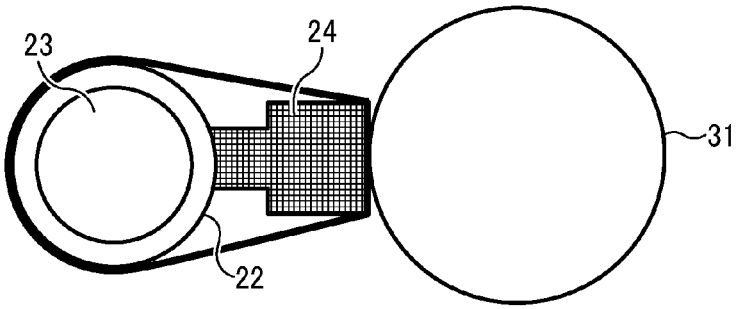
Figure 9C:
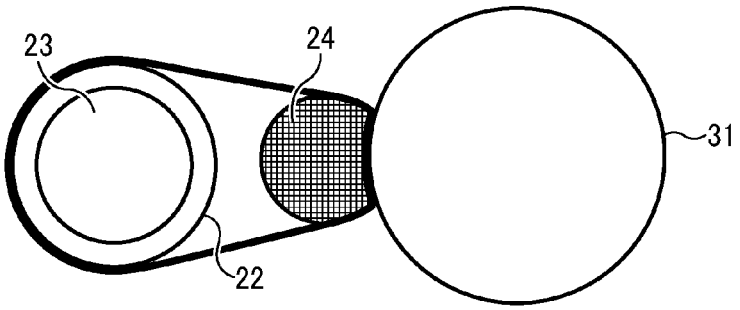

FIGS. 9A to 9C are diagrams schematically collectively illustrating various structures of the fixing device according to one embodiment of the present invention. Specifically, FIG. 9A illustrates a configuration, in which a pressing member 24 serving as a nip forming member to form a nip by pressing the fixing belt 21 is composed of a pad, and the pressing member 24 (i.e., the pad) is distanced from the heating roller 22.

FIG. 9B illustrates a configuration, in which a pressing member 24 serving as a nip forming member to form a nip by pressing the fixing belt 21 is composed of a pad, while the pressing member 24 (i.e., the pad) contacts the heating roller 22. That is, this configuration corresponds to the embodiment as shown in FIG. 2.

FIG. 9C illustrates a configuration, in which a pressing member 24 serving as a nip forming member to form a nip by pressing the fixing belt 21, and is composed of a freely rotatable roller member. With the configuration, as shown there, the pressing roller 24 is deformed by pressure.

In any configuration shown in FIGS. 9A, 9B, and 9C, a tension-applying member can be provided to apply tension in it and stretch the fixing belt 21, but is omitted to illustrate.

Here, when emission of the air from the interior of the heating roller and entrance thereof from the oust side are completely shut out, the heater can be damaged or cause the similar problem due to a change in air pressure therein. Because of this, it is desirable that the interior and the exterior of the heating roller are insulated by a prescribed degree not to change the air pressure in the heating roller.

Heretofore, the roller type-pressing roller is used. However, a pressing belt can be also employed instead of the pressing roller in the fixing device as well.

Further, any configuration can be optionally employed in each of components of the image forming apparatus. For example, the image bearer is not limited only to the drum type and can employ a belt type.

Further, the above-described various embodiments of the present invention can be applied to full-color and multicolor machines beside a monochromatic machine as well. Yet further, the above-described various embodiments of the present invention can be applied to direct transfer or intermediate transfer systems as well.

Of course, as the image forming apparatus, it is not limited to the above-described printer, and can include a copier, a facsimile, and a multiple functional machine having multiple functions.

As described heretofore, according to one embodiment of the present invention, the highly energy-efficient fixing device can be likely obtained. Because, the fixing device is configured such that an outer diameter of the heater knob (i.e., the holder section of the heater) and the inner diameter of the heating roller are almost the same, and the heating roller and the heater knob extend in an axial direction of the heating roller partially overlapping with each other at an overlapping region, air warmed by the heater in the heating roller is inhibited to evacuate from the heating roller along with the rotation of the heating roller, and external air (having room temperature) outside the heating roller is effectively prevented from entering an interior of the heating roller, the fixing device can reduce energy loss. More specifically, according to one aspect of the present invention, a fixing device comprises: a fixing belt to fix a toner image onto a recording medium transported to a fixing nip; a pressing member pressed against the fixing belt to form the fixing nip therebetween; a heating roller accommodating a heater to heat the fixing belt; and a holder to hold the heater at one end of the heater. In such a configuration, an inner diameter of the heating roller and an outer diameter of the holder are substantially the same, and the heating roller and the holder partially overlap with each other in an axial direction of the heating roller.

According to another aspect of the present invention, the more highly energy-efficient fixing device can be likely obtained. Because, the supporting member is composed of a bearing member to freely rotatably support the heating roller, and a non-contact section not contacting the heating roller is provided in a heating roller support section of the bearing member.

According to yet another aspect of the present invention, the more highly energy-efficient fixing device can be likely obtained.

According to yet another aspect of the present invention, the more heat transfer efficient and energy-efficient fixing device can be provided. Because, a relatively smaller diameter roller is employed as the heating roller and is approximated to the fixing heater (i.e., a lighting heat-generating section) so that a gap between the both parties of the heating roller and the fixing heater, and accordingly an amount of air to warm up is reduced.

According to yet another aspect of the present invention, the more heat transfer efficient and energy-efficient fixing device can be provided. Because, the heating roller and the heater are placed on the same axis and supported by the same supporting member.

According to yet another aspect of the present invention, the more heat transfer efficient and energy-efficient fixing device can be provided. Because, the gap between an inner circumferential surface of the heating roller and an outer circumferential surface of the holder of the heater is from about 0.1 mm to about 2 mm.

According to yet another aspect of the present invention, the more heat transfer efficient and energy-efficient fixing device can be provided. Because, the supporting member includes the bearing member (to support the heating roller to be able to freely rotating therearound) in its interior.

According to yet another aspect of the present invention, the more heat transfer efficient and energy-efficient fixing device can be provided. Because, the supporting member includes a belt regulator to suppress deviation of the belt.

According to yet another aspect of the present invention, the more heat transfer efficient and energy-efficient fixing device can be provided. Because, the interior and the exterior of the heating roller is insulated by the heating roller and the holder by a prescribed degree not to change air pressure in the heating roller even when emission of the air from the interior of the heating roller and entrance thereof from the oust side are completely shut out.

According to yet another aspect of the present invention, the more heat transfer efficient and energy-efficient fixing device can be provided. Because, a coefficient of thermal expansion of the supporting member is greater than those of the heating roller and the heater.

According to yet another aspect of the present invention, the more heat transfer efficient and energy-efficient fixing device can be provided. Because, the supporting member includes a hole for withdrawing wiring of the heater to an outside.

According to yet another aspect of the present invention, the more heat transfer efficient and energy-efficient fixing device can be provided. Because, multiple heater knobs (i.e., the holder sections of the heater) are provided at both ends of the fixing device, and the fixing device is configured such that an outer diameter of each of the heater knobs provided at both ends of the fixing device and the inner diameter of the heating roller are almost the same, and the heating roller and each of the heater knobs extend in an axial direction of the heating roller partially overlapping with each other at each of overlapping regions, air warmed by the heater in the heating roller is more effectively inhibited to evacuate from the heating roller along with the rotation of the heating roller, and external air (having room temperature) outside the heating roller is effectively prevented from entering an interior of the heating roller, the fixing device can more effectively reduce energy loss.

According to yet another aspect of the present invention, a highly energy-efficient image forming apparatus can be likely obtained. Because, the image forming apparatus includes an image forming unit to form a toner image on a recording medium, and a fixing device. The fixing device includes a fixing belt to fix a toner image onto a recording medium transported to a fixing nip, a pressing member pressed against an outer circumferential surface of the fixing belt to form the fixing nip therebetween, a hollow heating roller accommodating therewithin a heater to heat the fixing belt, and a holder to hold the heater at one end of the heater. Further, an inner diameter of the heating roller and an outer diameter of the holder are substantially the same, and the heating roller and the holder partially overlap with each other in an axial direction of the heating roller.

Numerous additional modifications and variations of the present invention are possible in light of the above teachings.

It is therefore to be understood that within the scope of the appended claims, the present invention may be executed otherwise than as specifically described herein. For example, components of the image forming apparatus are not limited to the above-described various embodiments and can be appropriately changed.

What is claimed is:

1. A fixing device comprising:

a fixing belt to fix a toner image onto a recording medium transported to a fixing nip;

a pressing member pressed against an outer circumferential surface of the fixing belt to form the fixing nip therebetween;

a hollow heating roller accommodating a heater therewithin to heat the fixing belt;

a holder to hold the heater at one end of the heater; and a supporting member that supports both the heating roller and the heater on the same axis, wherein an inner diameter of the heating roller and an outer diameter of the holder are substantially the same, and the heating roller and the holder partially overlap with each other in an axial direction of the heating roller, and wherein a coefficient of thermal expansion of the supporting member is greater than that of the heating roller and the heater.

2. The fixing device as claimed in claim 1, wherein the heating roller and the holder are disposed so as to insulate the interior and the exterior of the heating roller to the extent that air pressure within the heating roller remains unchanged.

3. The fixing device as claimed in claim 1, wherein the supporting member includes a hole for withdrawing wiring of the heater to an outside.

4. A fixing device comprising:

a fixing belt to fix a toner image onto a recording medium transported to a fixing a pressing member pressed against an outer circumferential surface of the fixing belt to form the fixing nip therebetween;

a hollow heating roller accommodating a heater therewithin to heat the fixing belt;

a holder to hold the heater at one end of the heater; and a supporting member that supports both the heating roller and the heater on the same axis, wherein an inner diameter of the heating roller and an outer diameter of the holder are substantially the same, and the heating roller and the holder partially overlap with each other in an axial direction of the heating roller, wherein the supporting member comprises a bearing member freely rotatable supporting the heating roller, wherein a non-contact section not contacting the heating roller is provided in a heating roller support section of the bearing member, and wherein the bearing member is accommodated within the supporting member.

5. A fixing device comprising:

a fixing belt to fix a toner image onto a recording medium transported to a fixing nip;

a pressing member pressed against an outer circumferential surface of the fixing belt to form the fixing nip therebetween;

a hollow heating roller accommodating a heater therewithin to heat the fixing belt;

a holder to hold the heater at one end of the heater; and a supporting member that supports both the heating roller and the heater on the same axis, wherein an inner diameter of the heating roller and an outer diameter of the holder are substantially the same, and the heating roller and the holder partially overlap with each other in an axial direction of the heating roller, and wherein the supporting member includes a belt regulator to suppress deviation of the belt.

6. The fixing device as claimed in claim 1, wherein a gap between an inner circumferential surface of the heating roller and an outer circumferential surface of the holder of the heater is from about 0.1 mm to about 2 mm.

7. The image forming apparatus as claimed in claim 3, wherein toner employing oil containing silica as an additive is used to develop the toner image.

8. An image forming apparatus comprising the fixing device as claimed in claim 1.

9. The fixing device as claimed in claim 4, wherein the heating roller and the holder are disposed so as to insulate the interior and the exterior of the heating roller to the extent that air pressure within the heating roller remains unchanged.

10. The fixing device as claimed in claim 4, wherein the supporting member includes a hole for withdrawing wiring of the heater to an outside.

11. The fixing device as claimed in claim 4, wherein a gap between an inner circumferential surface of the heating roller and an outer circumferential surface of the holder of the heater is from about 0.1 mm to about 2 mm.

12. An image forming apparatus comprising the fixing device of claim 4.

13. The image forming apparatus as claimed in claim 12, wherein toner employing oil containing silica as an additive is used to develop the toner image.

14. The fixing device as claimed in claim 5, wherein the heating roller and the holder are disposed so as to insulate the interior and the exterior of the heating roller to the extent that air pressure within the heating roller remains unchanged.

15. The fixing device as claimed in claim 5, wherein the supporting member includes a hole for withdrawing wiring of the heater to an outside.

16. The fixing device as claimed in claim 5, wherein a gap between an inner circumferential surface of the heating roller and an outer circumferential surface of the holder of the heater is from about 0.1 mm to about 2 mm.

17. An image forming apparatus comprising the fixing device as claimed in claim 5.

18. The image forming apparatus as claimed in claim 17, wherein toner employing oil containing silica as an additive is used to develop the toner image.

* * * * *